United States Patent [19]

Knoedler et al.

[11] Patent Number: 4,982,997

[45] Date of Patent: Jan. 8, 1991

[54] BOUNCER INFANT CARRIER

[75] Inventors: Roy E. Knoedler, Boulder; Robert M. Parker, Aurora; William G. Au, Northglenn; Albert W. Gebhard, Denver, all of Colo.

[73] Assignee: Snugli, Inc., Lakewood, Colo.

[21] Appl. No.: 402,234

[22] Filed: Sep. 5, 1989

Related U.S. Application Data

[63] Continuation of Ser. No. 228,531, Aug. 4, 1988, abandoned.

[51] Int. Cl.[5] ..... A47D 13/02

[52] U.S. Cl. ..... 297/296; 297/183; 297/302; 297/377

[58] Field of Search ..... 297/250, 377, 183, 5, 297/296–298, 300, 302; 248/561

[56] References Cited

U.S. PATENT DOCUMENTS

| | | | |
|---|---|---|---|
| 3,059,882 | 10/1962 | Staar | 248/561 |
| 3,297,360 | 1/1967 | Holmstrom | 297/300 |
| 3,334,944 | 8/1967 | Gould et al. . | |
| 3,409,325 | 11/1968 | Hamilton et al. . | |
| 3,922,035 | 11/1975 | Wener | 297/250 |
| 4,359,242 | 11/1982 | Gerken et al. | 297/5 |
| 4,371,206 | 2/1983 | Johnson, Jr. . | |
| 4,376,551 | 3/1983 | Cone | 297/250 |
| 4,500,133 | 2/1985 | Nakao et al. | 297/250 |
| 4,501,032 | 2/1985 | Heath et al. | 297/216 X |
| 4,516,806 | 5/1985 | McDonald et al. . | |
| 4,553,786 | 11/1985 | Lockett et al. | 297/250 |
| 4,566,667 | 1/1986 | Yanagisawa | 248/561 |
| 4,613,188 | 9/1986 | Tsuge et al. | 297/250 |
| 4,634,177 | 1/1987 | Meeker . | |
| 4,681,368 | 7/1987 | Heath et al. . | |
| 4,688,850 | 8/1987 | Brownlie et al. . | |
| 4,718,715 | 1/1988 | Ho | 297/250 |
| 4,790,595 | 12/1988 | Hensel et al. | 297/302 |

*Primary Examiner*—Peter R. Brown

*Attorney, Agent, or Firm*—Sheridan, Ross & McIntosh

[57] ABSTRACT

An infant carrier is provided which is capable of being positioned in various configurations in order to suit the various activities in which a infant can be involved. The body of the carrier is movably attached to the base in order that they can be moved to various positions relative one another. In a first position, the body of the carrier and the base are adjacent one another and in a second position the carrier body is moved a limited distance away from the base. In this second position, the carrier body is capable of a bouncing motion which can be activated by the infant's own movement or another person's touch. Preferably additional configurations, such as configurations in which an infant in the infant carrier can be easily fed or carried, are also obtainable.

10 Claims, 11 Drawing Sheets

BOUNCER INFANT CARRIER

This is a continuation of application Ser. No. 07/228,531, filed Aug. 4, 1988, abandoned.

FIELD OF THE INVENTION

The present invention relates to infant carriers, and more specifically, to infant carriers which are positionable in a number of different configurations to suit the various activities in which infants can be involved.

BACKGROUND OF THE INVENTION

Infant carriers are well known, and many different models are presently available. For example, the following U.S. patents all disclose infant carriers: U.S. Pat. No. 4,688,850, by Brownlie et al., issued Aug. 25, 1987; U.S. Pat. No. 4,681,368, by Heath et al., issued July 21, 1987; U.S. Pat. No. 4,634,177, by Meeker, issued Jan. 6, 1987; U.S. Pat. No. 4,516,806, by McDonald et al., issued May 14, 1985; U.S. Pat. No. 4,501,032, by Heath et al., issued Feb. 26, 1985; U.S. Pat. No. 4,371,206, by Johnson, Jr., issued Feb. 1, 1983; U.S. Pat. No. 3,409,325, by Hamilton et al., issued Nov. 5, 1968; and U.S. Pat. No. 3,334,944, by Gould et al., issued Aug. 8, 1967.

One of the more important features an infant carrier can provide is ease of transportation. For this reason the vast majority of infant carriers include a handle by which they can be carried. U.S. Pat. Nos. 4,681,368 and 4,501,032 disclose bassinets which can be carried by dual handles. However, as is readily apparent from the figures for these patents, the shape of these dual handles makes it unwieldy to grasp both handles simultaneously, especially for those with small hands. Therefore, it would be advantageous to have dual handles that can be easily grasped. It would also be desirable to have an infant carrier which can be carried in a manner other than by the handles, for example, cradled in one's arms.

Another important requirement for infant carriers is that they are stable when placed upon a flat surface. To this end, some infant carriers have been provided with bases, such as those disclosed in U.S. Pat. Nos. 4,634,177 and 4,516,806. However, the shapes of these bases are unwieldy. Therefore, the base is commonly removed when the infant carrier is transported, or, if left attached to the carrier body, the base makes it difficult for one to carry the infant carrier cradled in one's arms. Therefore, it would be advantageous to have a base which provides stable support when the infant carrier is placed on a flat surface, yet which does not interfere when the infant carrier is being carried.

In addition to functioning as a simple carrier, it is advantageous for an infant carrier to perform other tasks. For example, U.S. Pat. Nos. 3,409,325 and 3,334,944 disclose infant carriers in which the head can be raised, thereby allowing an infant to be fed while in an upright position. U.S. Pat. Nos. 4,688,850 and 4,371,206 disclose carriers which can also function as rockers. While the soothing effect of a rocking motion on infants is well known, rockers sometimes suffer from the disadvantage of poor stability. Additionally, they usually require an external touch to activate the rocking motion.

Therefore, it would be advantageous to provide an infant carrier that is positionable in a number of configurations, such as a resting configuration, a feeding configuration, etc. It would also be desirable if in one of the configurations the infant carrier is both stable and capable of soothing motion. It would be especially advantageous if this motion can be triggered by the infant's own movement.

SUMMARY OF THE INVENTION

In accordance with the present invention, an infant carrier is provided comprising a carrier body in which an infant can be placed, a stable base, and a device for connecting the carrier body to the base. The connecting device allows the carrier body to be placed in at least two positions relative to the base.

In the first position, which will be termed the "rest" position for present purposes, the carrier body and the base are adjacent one another. In this first rest position, the infant carrier is in a relatively stable configuration. In a preferred embodiment, the two members are configured so that the upper surface of the base mates with the adjacent lower surface of the carrier body thereby increasing the stability of the infant carrier.

In a second position, termed the "bouncing" position for present purposes, the carrier body and base are separated by a limited distance, yet remain connected to each other by way of the connecting device. In this bouncing position the base provides stable support against a flat surface, and the carrier body is free to move, or bounce, slightly. This bouncing motion is activated by the infant's own movement, or alternatively, by another person's touch.

In another preferred embodiment of the present invention, the infant carrier further includes dual carrying handles. These handles are rotatably attached to the carrier body. When in use, the handles swing up and interlock with each other for ease of carrying. When the handles are not being used they swing down and out of the way.

In yet another preferred embodiment, the infant carrier of the present invention is provided with a mechanism for raising the head of the infant carrier. For present purposes, the position the infant carrier assumes when the head is raised will be termed the "feeding" position.

The infant carrier of this present invention provides a number of advantages over the prior art. It can be positioned in a number of configurations, and is, therefore, extremely versatile. Additionally, the base provides stability when the infant carrier is placed on a flat surface. Furthermore, the unique connecting device allows the infant carrier to attain a bouncing position, which is both stable, yet allows the infant's own movement to create a soothing, bouncing motion.

DETAILED DESCRIPTION OF THE INVENTION

Figure 1:
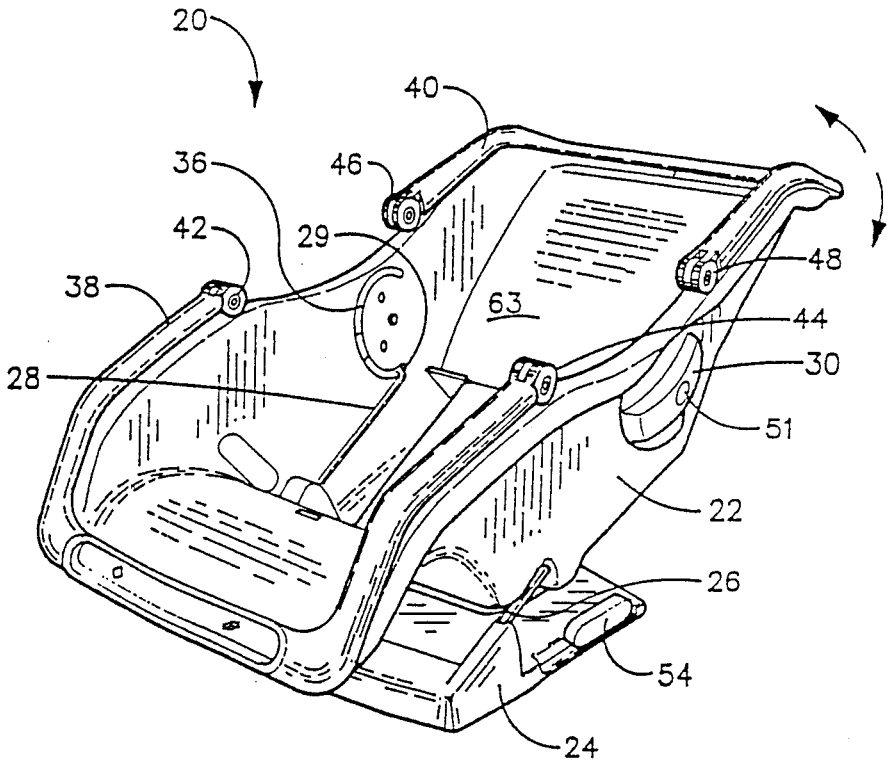
FIG. 1 illustrates a front perspective view of one embodiment of the infant carrier of the present invention in the bouncing position.

The present invention will be described with reference to the embodiment of the infant carrier illustrated in FIG. 1. The bouncer infant carrier 20 is shown in the bouncing position. The infant carrier 20 includes a carrier body 22 in which an infant can be placed. Padding (not shown) can be used to line the interior of the carrier body 22. The infant carrier body 22 is joined to a base 24 by a connecting device such as spring rods 26 and 28.

The connecting device serves two purposes. First it movably connects the base to the carrier body. The movable connection provided by the connecting device permits the base 24 and carrier body 22 to be moved between at least two positions relative to one another. In a first position, the carrier body 22 is adjacent to the base 24. As used herein to describe the relative positions of the base 24 and the carrier body 22, the term "adjacent" will mean that the bottom portion 23 of the carrier body 22 is contiguous with the top portion 25 of the base 24 as illustrated in FIG. 2. In a second position, the carrier body 22 is moved a limited distance away from the base 24 along spring rods 26 and 28 as illustrated in FIG. 1. This positioning is accomplished by moving the carrier body 22 along the longitudinal axes of the "connecting portions" of the spring rods 26 and 28 shown in FIG. 1. As used herein, the term "connecting portions" of the spring rods 26 and 28 will be understood to mean that portion of the spring rods 26 and 28 along which the carrier body 22 is capable of moving. In addition to the connecting portion, the spring rods 26 and 28 also have an "anchor portion" by which the spring rods 26 and 28 are fixably attached to the base 24.

An assembly for effecting the relative movement between the carrier body 22 and the base 24 includes rotatable handles 30 and 32 (32 shown in FIG. 3) and semi-circular guides 34 and 36 (34 shown in FIG. 10) for the spring rods 26 and 28. An end 29 of the spring rod 28 is bent outwards at approximately a 90° angle relative to the longitudinal axis of the spring rod 28. This end 29 passes through the guide 36 and engages rotatable handle 32 (32 shown in FIG. 3). The assembly for effecting relative movement between the carrier body 22 and the base 24 will be described in more detail hereinafter.

Figure 2:
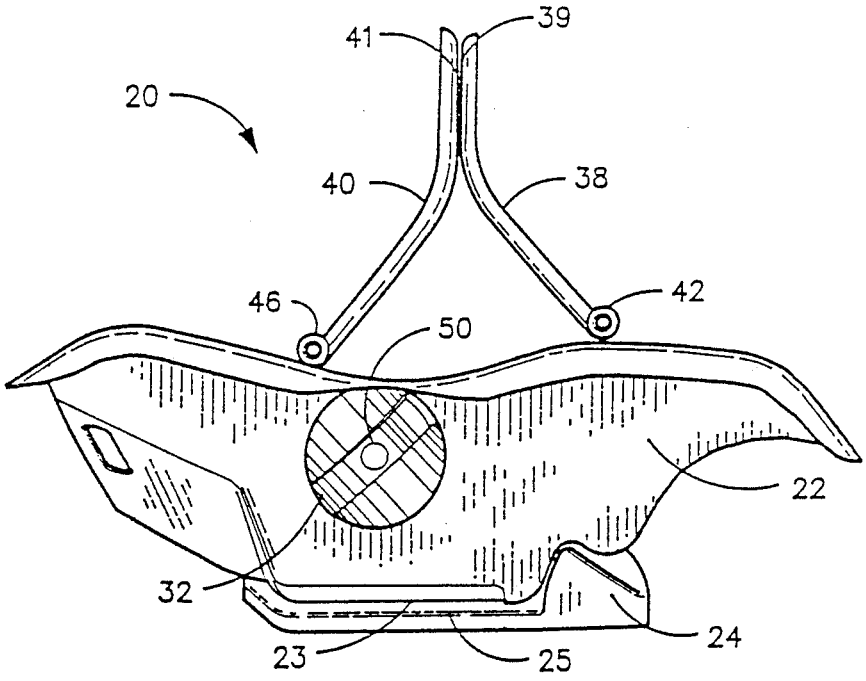
FIG. 2 illustrates a side plan view of the infant carrier in the carry position.

The second purpose served by the connecting device is allowing the carrier body 22 to "bounce" when the infant carrier 20 is in the bouncing position as shown in FIG. 1. When in the bouncing position, the infant carrier body 22 is capable of limited reciprocative, or "bouncing," motion in the directions shown by the arrows, that is, towards and away from a surface on which the infant carrier 20 is placed. This reciprocative motion can be activated by an infant's movement or by another person's touch. In order to provide this reciprocative motion, the spring rods 26 and 28 must be rigid enough to support the carrier body 22 in the position shown in FIG. 1, yet flexible enough to yield slightly in response to an infant's movement or another person's touch. In this manner, the carrier body 22 will bounce slightly in response to such stimulation.

The actual distance which separates the carrier body 22 from the base 24 when the infant carrier 20 is in the bouncing position shown in FIG. 1 must be sufficient to permit the carrier body 22 to bounce without interference from the base 24. Preferably the distance is from about 1 to about 12 inches.

As will be understood by those skilled in the art, the connecting device may be shaped in a wide variety of configurations and can be made of a wide variety of materials. With respect to the configuration, the key characteristics which the connecting device must possess is that it must be capable of being fixably attached to the base 24 and also provide for limited movement of the carrier body 22 relative to the base 24. With respect to the materials out of which the connecting device may be fabricated, the materials must be strong yet somewhat flexible. Suitable materials include metals, such as steel, and polymeric materials, including reinforced polymeric materials.

Dual handles 38 and 40 are provided for use in carrying the infant carrier 20. As shown in FIG. 1, the dual handles 38 and 40 are adjacent to the upper edge of the carrier body 22 and are shaped to conform thereto. Pivot pins 42 and 44 are provided for pivoting handle 38 in an upward direction (i.e. clockwise from the position shown in FIG. 1) and pivot pins 46 and 48 are provided for pivoting handle 40 in an upward (counterclockwise) direction.

FIG. 2 illustrates the infant carrier 20 in the carry position. The two handles 38 and 40 have been pivoted upward to provide ease of carrying. As shown in FIG. 2, the handle 38 has been pivoted in a counterclockwise direction about pivot pins 42 and 44 (44 not shown) and handle 40 has been pivoted in a clockwise direction about pivot pins 46 and 48 (48 not shown). The upper portions 39 and 41 of the handles 38 and 40 are adjacent and preferably are provided With a mechanism for interlocking the adjacent upper portions 39 and 41 of the two handles 38 and 40. Examples of suitable interlocking mechanisms include a tab located on one handle 38 which frictionally engages a corresponding recess located on the other handle 40 when the two handles 38 and 40 are adjacent one another. The friction caused by the engagement is enough to maintain the handles in their adjacent positions, but is not so great as to interfere with the separation of the handles when they are disengaged from one another and placed in the positions shown in FIG. 1.

In FIG. 2, the carrier body 22 has been repositioned relative to the spring rods 26 and 28 (shown in FIG. 1) so that it is now adjacent the base 24. This repositioning is accomplished by rotating the rotatable handle 32 in a counterclockwise direction about pivot 50. Simultaneously rotatable handle 30 is rotated about pivot pin 51 (see FIG. 1) in a clockwise direction. The function of the rotatable handles 30 and 32 in changing the relative positions of the base 24 and the carrier body 22 will be described in more detail hereinafter. As can be seen in FIG. 2, the bottom portion 23 of the carrier body 22 and the top portion 25 of the carrier base 24 are preferably shaped such that they mate when adjacent one another.

Figure 3:
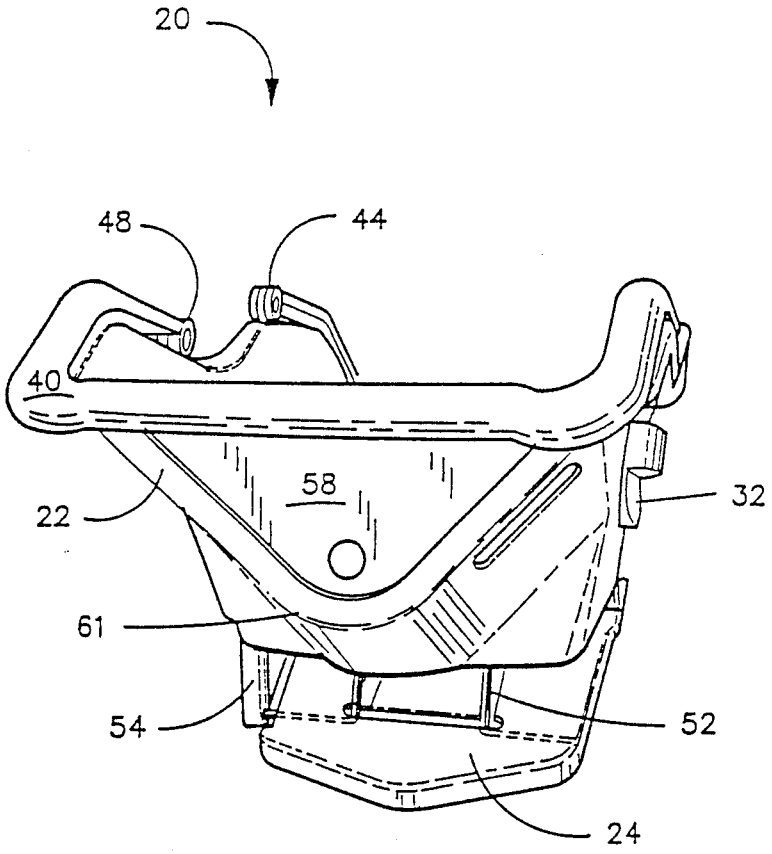
FIG. 3 illustrates a perspective view of the back of the infant carrier in the feeding position.
Figure 4:
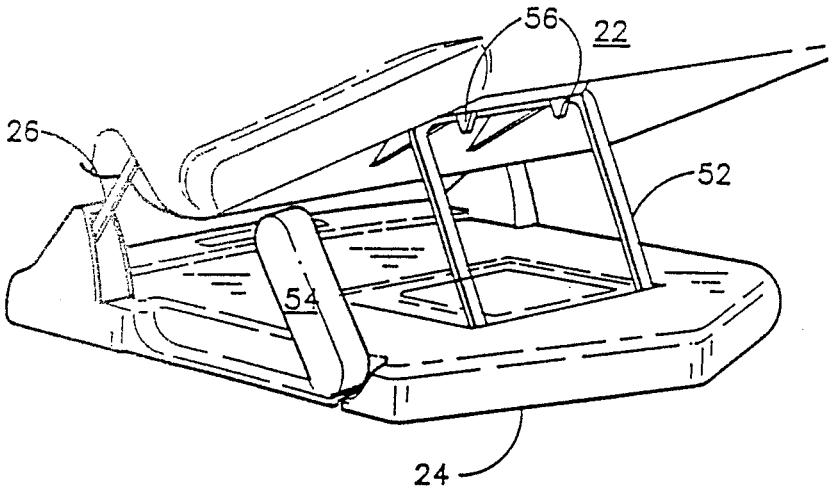
FIG. 4 illustrates a close-up perspective view of the infant carrier in the feeding position showing the base, a feeding bracket and a portion of the bottom of the carrier body.

FIG. 3 illustrates the back portion of the infant carrier 20 in the feeding position. A feeding bracket 52 (shown partially in phantom lines) is shown in a raised position. Feeding bracket handle 54 is used to raise and lower the feeding position bracket 52. The feeding bracket 52 and its positional relationship with the base 24 and bottom of the carrier body 22 is shown in greater detail in FIG. 4. As shown in FIG. 4, the feeding bracket handle 54 has been rotated clockwise from the position shown in FIG. 1, thus raising the feeding bracket 52 so that it engages bracket tabs 56 on the bottom portion 23 of the carrier body 22. In this manner, the feeding bracket 52 prevents the carrier body 22 from bouncing. A child placed in the infant carrier body 20 will have its head raised relative to the base 24 and therefore be in a better position for feeding when the infant carrier 20 is in the feeding position. At the same time, the infant's movement will not stimulate the bouncing motion, as would be the case if the feeding bracket 52 were rotated downward by rotating the feeding bracket handle 54 in a counterclockwise direction to attain the bouncing position shown in FIG. 1. As will be appreciated by those skilled in the art, the feeding bracket can have different configurations than illustrated in the figures. The feeding bracket location can also be varied. For example, the feeding bracket can be rotatably attached to the carrier body 22 and the bracket tabs can be located on the base 24.

Figure 5:
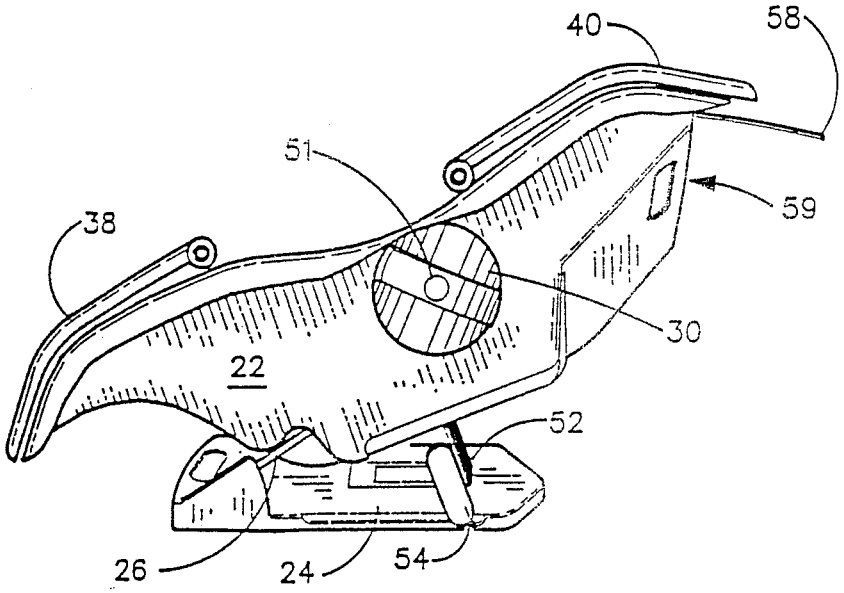
FIG. 5 illustrates a side plan view of the infant carrier in feeding position.

FIG. 3 also illustrates a cover 58 for an optional storage compartment, shown in a closed position. When the storage compartment cover 58 is opened, access is provided to the interior of a storage compartment 59 (see FIG. 5) which is defined by walls 61 and the interior bottom portion 63 (see FIG. 1) of the infant carrier body 22. The interior bottom portion 63, shown in FIG. 1, can be formed as an integral part of the carrier body 22 or, alternatively, as a separate member to be inserted during assembly. FIG. 5 illustrates the storage compartment cover 58 in an open position.

FIG. 5 also shows a side view of the infant carrier 20 in the feeding position. The carrier body 22 has been moved a limited distance away from the carrier base 24 along spring rod 26. This movement has been effected by rotating rotatable handle 30 in a counterclockwise direction around pivot pin 51. The feeding bracket 52 is raised, thereby preventing the infant carrier body 22 from bouncing.

Figure 6:
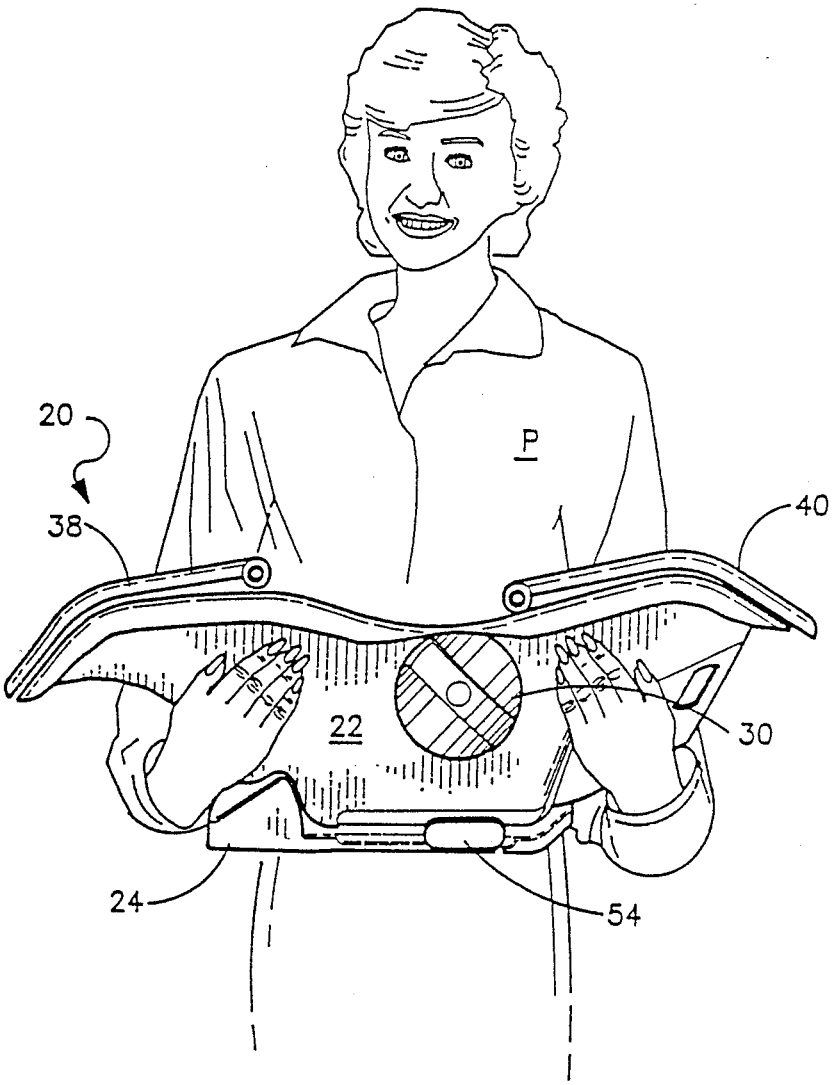
FIG. 6 illustrates the infant carrier being carried cradled in a person's arms.

FIG. 6 illustrates the infant carrier 20 of the present invention being carried in a person's arms. The shape of the carrier body 22 and the fact that the base 24 can be moved adjacent the carrier body 22 provides an infant carrier 20 which can be easily carried in this manner.

Figure 7:
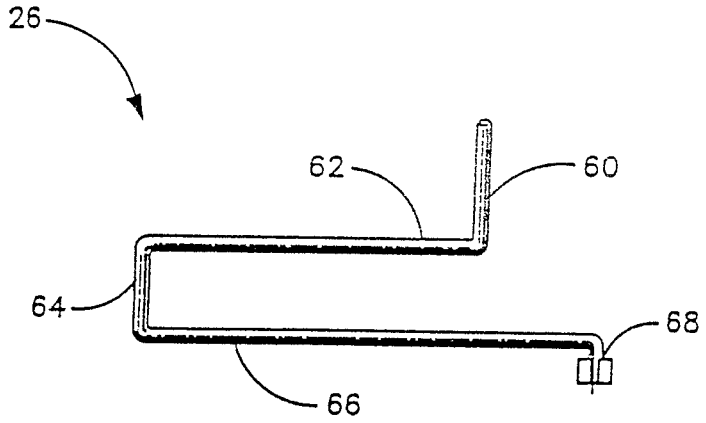
FIG. 7 illustrates a top plan view of a spring rod.
Figure 8:
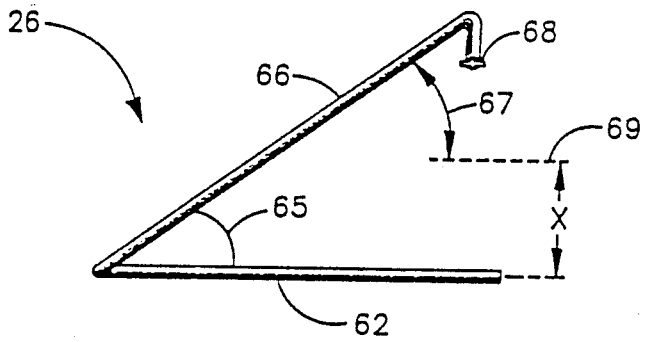
FIG. 8 illustrates a side plan view of a spring rod.
Figure 9:
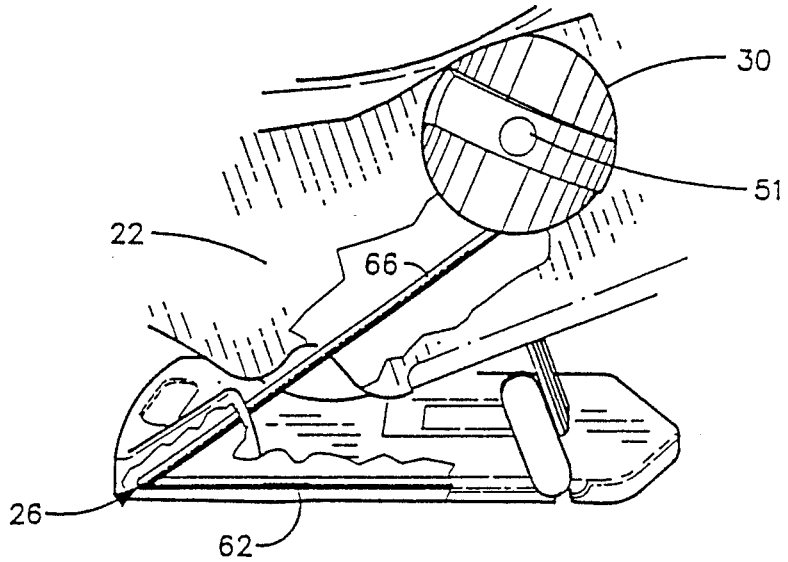
FIG. 9 illustrates a side plan view of the infant carrier in the feeding position with a portion cut-away to reveal a spring rod in place.

The operation of the spring rods 26 and 28 in cooperation with rotatable handles 32 and 34 in effecting limited relative movement between the carrier body 22 and the base 24 will now be explained in greater detail. A top view of a spring rod is shown in FIG. 7. In a preferred embodiment the spring rod comprises an end portion 60, a lower portion 62, a closed end portion 64, a raised portion 66, and a nip portion 68. The end portion 60, lower portion 62 and closed end portion 64 together comprise the anchor portion of the spring rod, as defined hereinbefore. The raised portion 66 and nip portion 68 together comprise the connecting portion of the spring rod, as defined hereinbefore. A side plan view of the spring rod is shown in FIG. 8. In FIG. 9 portions of the sidewall of the carrier body 22 and the base 24 have been cut away to expose the lower portion 62 and raised portion 66 of the spring rod 26 in place in the infant carrier 20. Only one spring rod 26 of the two spring rods 26 and 28 will be described in detail. It will be understood that the other spring rod 28 functions in an analogous manner on the other side of the infant carrier 20.

Figure 10:
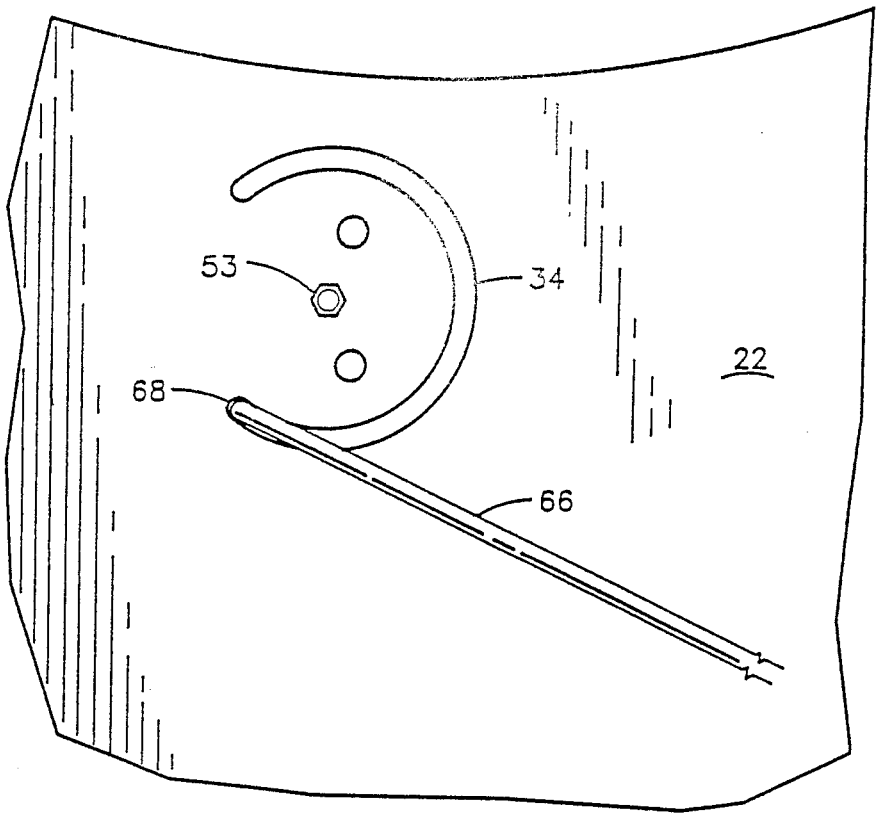
FIG. 10 illustrates a close-up view of a portion of a spring rod in relation to a spring rod guide.
Figure 11:
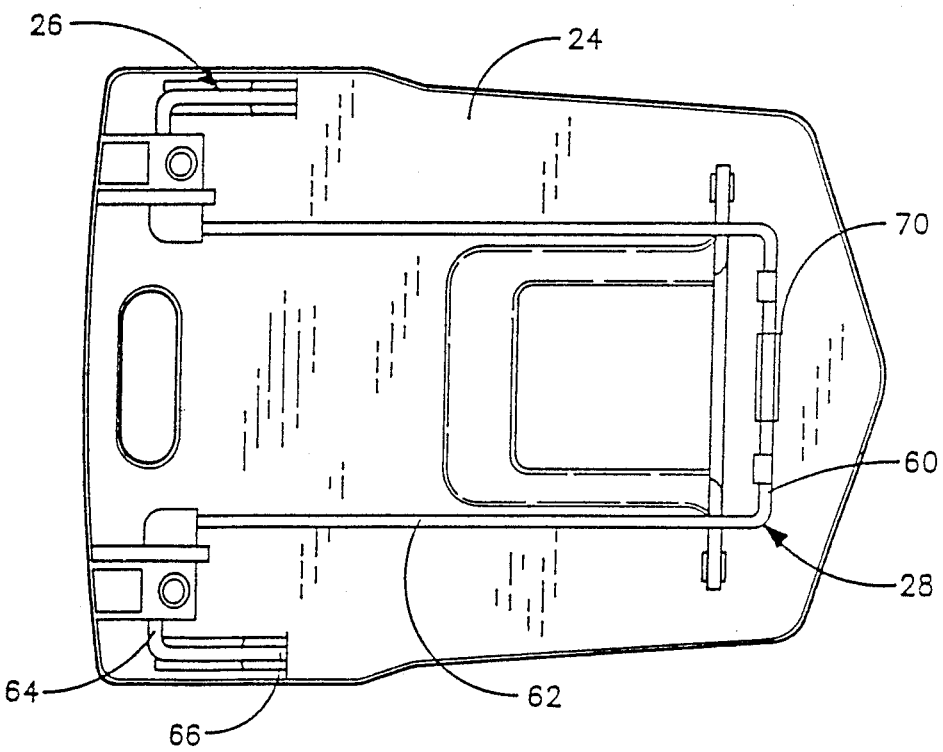
FIG. 11 illustrates a bottom plan view of the infant carrier base showing portions of a pair spring rods and portions of the feeding bracket.

The upper portion 66 of the spring rod 26 terminates in a nip portion 68. This nip portion 68 is pivotably attached to the rotatable handle 30 as is shown from outside the carrier body 22 in FIG. 9 and from inside the carrier body 22 in FIG. 10. A semi-circular guide 34 for spring rod 26 is formed in the sidewall of the infant carrier body 22, as shown in FIG. 10. The nip 68 of the spring rod 26 passes through the spring rod guide 34 and engages the rotatable handle 30. The rotatable handle 30 can be rotated both clockwise and counterclockwise to move the nip portion 68 of the spring rod 26 within the limits of the guide 34.

The rotatable handle 30 is rotatably secured to the carrier body 22 by way of pivot-pin 51 which can pass through and be secured to the carrier body 22 by a fastener, such as a nut or rivet 53. The spring rod 26 is pivotally secured to the rotatable handle 30, for example, the nip portion 68 of the spring rod 26 can be received in a hole in the rotatable handle 30. When the rotatable handle 30 is rotated, the carrier body 22 will move in a direction substantially parallel to the longitudinal axis of the raised portion 66 of the spring rod 26. When the spring rod 26 is in the position shown in FIGS. 9 and 10, the carrier body 22 will be a limited distance away from the base 24, as illustrated in FIG. 9. When the rotatable handle 30 is rotated so that nip portion 68 of the spring rod 26 is positioned at the uppermost limit of the spring rod guide 34, the carrier body 22 will be adjacent the carrier base 24 as shown in FIG. 2.

As stated hereinabove, the spring rods 26 and 28 must be strong yet flexible. One indication of whether the spring rods 26 and 28 have the requisite strength and flexibility is when the connecting portion of a spring rod 26 can be deflected a certain distance without permanently deforming the spring rod 26. This will be illustrated with reference to FIG. 8, which illustrates a side view of a spring rod 26. By way of example, it will be assumed that the upper portion 66 of the spring rod 26 is about 11.6 inches long and the lower portion 62 of the spring rod is about 10.75 inches long. The angle 65 between the lower portion 62 and the upper portion 66 is approximately 35°. In order to test the flexibility and strength of the spring rod, the anchor portion is secured at both ends against a surface. The upper connecting portion is then deflected in a direction indicated by arrow 67 towards imaginary baseline 69. The distance X between the anchor portion of the spring rod 26 and the imaginary baseline 69 is selected to indicate the requisite flexibility. In testing, the connecting portion must be capable of deflecting in the direction shown by arrow 67 to the baseline 69 without permanent deformation. In the present illustrative example, a suitable distance for X would be 3 inches.

As will be appreciated by those skilled in the art, various alternative means can be employed for effecting the relative movement between the base 24 and carrier body 22. For example, instead of having the semi-circular guides 34 and 36, a portion of the spring rod can be provided with gear teeth or serrations and the rotatable handle can be provided with a circular gear so that the gear teeth of the circular gear on the handle engage the teeth on the spring rod, and effect relative movement when the rotatable handle is turned. Alternatively, the spring rod may be engaged in a linear, rather than semi-circular, guide. In this manner, relative movement between the base 24 and carrier body 22 may be effected simply by holding the base 24 down while pushing or pulling the carrier body 22 in a direction parallel to the longitudinal axis of the connection portion of spring rods. A mechanism for securing the carrier body 22 at various positions can also be provided. For example, detents within the linear guide which can be engaged by the nip portion 66 of the spring rod 26 can be used to secure the carrier body 22 at various discrete positions.

Figure 12:
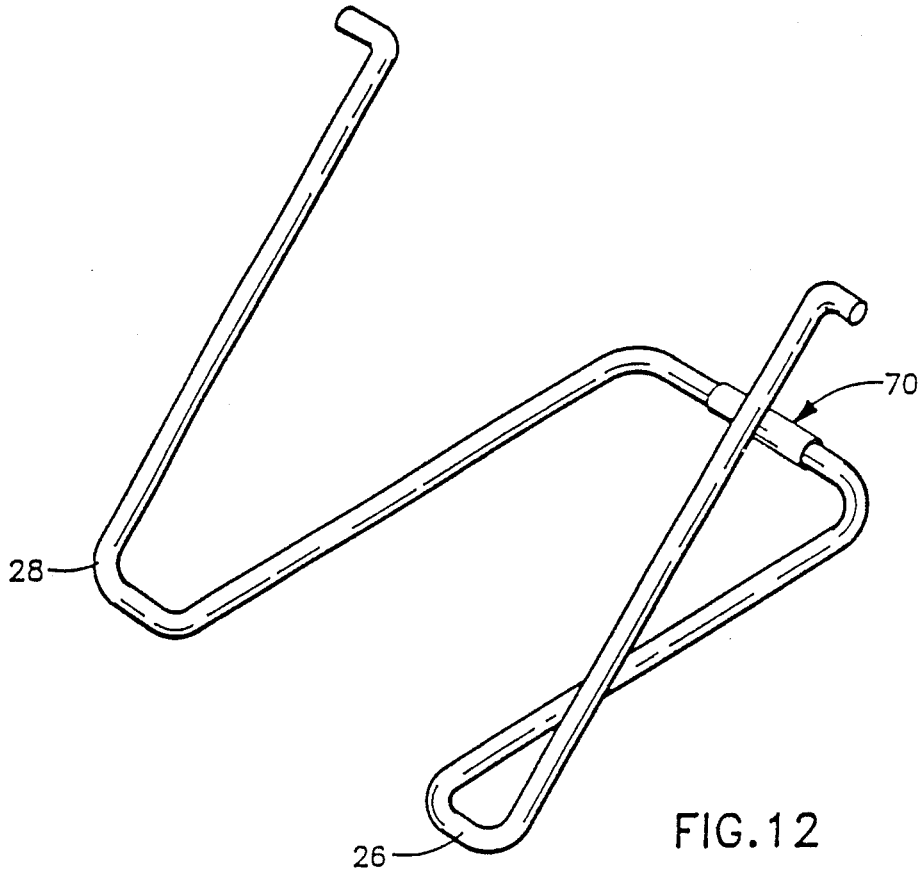
FIG. 12 illustrates a perspective view of a pair of spring rods.

In the bottom view of the base illustrated in FIG. 1, the anchor portions of the spring rods 26 and 28 are shown as two separate units joined by connector 70. A perspective view of spring rods 26 and 28 joined by connector 70 is shown in FIG. 12. Alternatively, the spring rod could be manufactured as a single unit. Also it will be understood that different configurations of the spring rod can be employed to accomplish the relative movement between the base 24 and the carrier body 22 and to provide for the bouncing motion of the carrier body 22 when it is a limited distance away from the base 24.

As will be appreciated by those skilled in the art, the infant carrier of the present invention can be constructed of various materials such as metals and polymeric materials such as polyesters, polyolefins, and other plastic materials. As will be well understood, the metal materials can be coated or painted. Various additives can be included with the polymeric materials in order to color and/or strengthen the same. Additionally, a pad or form of padding can be provided on the interior of the carrier body for the comfort of the infant. Straps can be provided in order to secure an infant within the carrier body. Brackets can be provided on the infant carrier in order that it can be strapped to a car seat through the use of a seatbelt.

While various embodiments of the present invention have been described in detail, it is apparent that modifications and adaptations of those embodiments will occur to those skilled in the art. However, it is to be expressly understood that such modifications and adaptations are within the spirit and scope of the present invention, as set forth in the following claims.

What is claimed is:

1. An infant carrier comprising:

(a) a carrier body in which an infant can be placed, said carrier body including first and second sides with each of said first and second sides having an inner wall surface and first and second substantially arcuate-shaped slots being provided at each of said inner wall surfaces of said first and second sides respectively;

(b) a base which is capable of supporting said carrier body above a surface and is movably connected to said carrier body;

(c) connecting means for movably connecting said base to said carrier body, wherein said connecting means provides for positioning said carrier body and said base in at least two positions relative to one another and, for each of said two positions, an infant is supportable in said carrier body and in which, in a first position said carrier body and said base are substantially adjacent one another and substantially immobile relative to one another so that said carrier body is adapted to support the infant in order to carry the infant and, in a second position, said carrier body is located a distance away from said base so that said carrier body is adapted to support the infant in an inclined position relative to said base; and (d) at least a first rotatable member attached to said carrier body adjacent to said first arcuate-shaped slot;

wherein said connecting means includes at least a first elongated member including an end portion and having a longitudinal axis, said elongated member end portion being held in said first arcuate-shaped slot and wherein said carrier body moves along said elongated member toward said base to travel from said second position to said first position during movement of said first rotatable handle as said elongated member end portion is guided in said first arcuate-shaped slot.

2. The infant carrier of claim 1 wherein said elongated member comprises at least one spring rod having a substantially circular cross-section extending through portions of said carrier body.

3. The infant carrier of claim 1 wherein substantial portions of said connecting means are hidden from view when said carrier body is in said second position by locating said substantial portions beneath said base and interiorly of said carrier body.

4. The infant carrier of claim 1 wherein the bottom portion of said carrier body and the top portion of

5. The infant carrier of claim 1 further comprising two handles rotatably attached to said carrier body and wherein said handles are shaped so that:

(a) when said handles are rotated downwardly, said handles are adjacent to and conform to the shape of said carrier body; and (b) when said handles are rotated upwardly into a carry position said handles interlock and can be grasped simultaneously.

6. The infant carrier of claim 1 further including a bracket rotatably attached to said infant carrier, and positionable in at least two positions wherein:

(a) in a first position and bracket does not prevent said carrier body from up-and-down movement; and (b) in a second position said bracket interconnects said carrier body and said base to substantially prevent movement of said carrier body in a substantially downward direction.

7. The infant carrier of claim 1 wherein the carrier body is shaped to allow the infant carrier to be carried or cradled in a person's arms.

8. An infant carrier, comprising:

a carrier body having a longitudinal axis and first and second sides, with said first and second sides having inner wall surfaces, wherein said carrier body is adapted to support an infant placed in said carrier body with the infant extending in the direction of said longitudinal axis;

a base for placement on a support surface, said base being connected to said carrier body, said carrier body being movable relative to said base; and spring rod means for connecting said carrier body to said base and including a first elongated rod member and a second elongated rod member, said first elongated rod member including portions extending inside of said carrier body adjacent to said inner wall surface of said first side, said carrier body being positionable in two positions relative to said base, in a first position, said carrier body and said base are substantially adjacent to one another and second elongated rod member extends in substantially the same direction as said carrier body longitudinal axis and, in a second position, said carrier body is located a distance away from said base, wherein said carrier body is adapted to support the infant in an inclined position relative to said base and, in second position, said first elongated rod member is deflectable relative to said second elongated rod member wherein said carrier body has up-and-down movement relative to said base and said second elongated rod member is substantially fixed in position during said movement, said first elongated rod member generating a spring force when said carrier body is moved towards said base during said up-and-down movement with said spring force including a substantial vertical component in a direction relative to said base and the support surface whereby said spring force causes said carrier body to move away from said base.

9. The infant carrier of claim 13, further comprising first and second rotatable handles, said first rotatable handle being connected to a first side of said carrier body adjacent to an arcuate-shaped slot formed in said first side, wherein an end portion of said first elongated rod member is provided in said arcuate-shaped slot and said first rotatable handle is rotated to cause a change in position of said carrier body relative to said base.

10. The infant carrier of claim 8 further comprising two handles rotatably attached to said carrier body and wherein said handles are shaped so that, once said handles are rotated into a position for carrying the infant carrier, said handles interlock and can be grasped simultaneously.

* * * * *